US006568984B1

(12) United States Patent
Applewhite

(10) Patent No.: US 6,568,984 B1
(45) Date of Patent: May 27, 2003

(54) TOY FIGURINE

(75) Inventor: John T. Applewhite, Marietta, GA (US)

(73) Assignee: Johnson Research & Development Co., Inc., Smyrna, GA (US)

( * ) Notice: Subject to any disclaimer, the term of this patent is extended or adjusted under 35 U.S.C. 154(b) by 0 days.

(21) Appl. No.: 09/648,457

(22) Filed: Nov. 9, 2000

(51) Int. Cl.[7] ..... A63H 33/40; A63H 3/36; A63H 11/00

(52) U.S. Cl. ..... 446/176; 446/320; 446/330; 446/379; 446/390

(58) Field of Search ..... 446/176, 195, 446/196, 197, 198, 199, 320, 330, 376, 379, 390, 385; 901/17, 22

(56) References Cited

U.S. PATENT DOCUMENTS

| | | | | | |
|---|---|---|---|---|---|
| 3,346,989 | A | * | 10/1967 | Ryan et al. | 446/198 |
| 3,695,148 | A | * | 10/1972 | Baginski et al. | 446/197 |
| 3,740,893 | A | * | 6/1973 | Shinoda | 446/198 |
| 4,259,805 | A | | 4/1981 | Hornsby, Jr. | 46/44 |
| 4,576,585 | A | | 3/1986 | Balogh et al. | 446/199 |
| 4,583,957 | A | | 4/1986 | Levy | 446/177 |
| 4,776,852 | A | * | 10/1988 | Rubic | 623/26 |
| 4,899,644 | A | * | 2/1990 | Susnjara | 92/18 |
| 5,040,626 | A | * | 8/1991 | Paynter | 180/8.1 |
| 5,104,346 | A | | 4/1992 | Smrt | 446/199 |
| 5,394,766 | A | * | 3/1995 | Johnson et al. | 74/490.01 |
| 5,419,729 | A | | 5/1995 | Gross | 446/183 |
| 5,664,983 | A | | 9/1997 | Hollis | 446/199 |
| 5,913,708 | A | * | 6/1999 | Gross | 446/385 |

* cited by examiner

*Primary Examiner*—Jacob K. Ackun
*Assistant Examiner*—Faye Francis
(74) *Attorney, Agent, or Firm*—Baker, Donelson, Bearman & Caldwell

(57) ABSTRACT

A toy figurine 10 is disclosed having a torso 13, a right arm 14, a left arm 15, a right leg 16, a left leg 17 and a head 18. Each arm 14 has a right shoulder portion (22, 29), an elbow portion (23, 30) and a wrist portion (24 31). The shoulder portions are coupled to the elbow portions by upper arm pneumatic cylinders (25, 32). The elbow portions 23 are coupled to the wrist portions by lower arm pneumatic cylinders (26, 33). Each leg (16, 17) has a thigh portion (36, 43), a knee portion (37, 44) and a foot portion (38, 45). The thigh portions are coupled to the knee portions by upper leg pneumatic cylinders (39, 46). The knee portions are coupled to the foot portions by a lower leg pneumatic cylinder (40, 47). The figurine also includes an internally mounted manual air pump (50) positioned within an internally mounted pressure tank (51). The pressure tank is coupled to a conduit system (60) having a multiple control valve assembly (61) which control the flow of pressurized air through the individual conduits (71, 72, 73 and 74) of the conduit system to the pneumatic cylinders of the arms and legs.

11 Claims, 6 Drawing Sheets

TOY FIGURINE

TECHNICAL FIELD

This invention relates to toy figurines, and specifically to toy figurines which are pneumatically actuated.

BACKGROUND OF THE INVENTION

Figurines, such as dolls, have existed for centuries. Today's dolls typically have manually manipulable legs, arms and heads. These dolls may be articulated to assume many different positions. However, these dolls are generally considered to be static.

Some figurines have been developed which give the illusion or impression of growth or movement. U.S. Pat. No. 4,259,805 discloses an inflatable doll having a body formed of an elastic material so that the body may be inflated with pressurized air. The pressurized air is provided by a manual air pump coupled to the elastic body. This type of figurine however requires the actuation of the manual pump with each occurrence of expansion. As such, the figurine can not be quickly transformed from one configuration to another. U.S. Pat. No. 5,419,729 similarly shows a doll or mannequin that includes elastic features to provide the illusion of growth attributed to weight or muscle gain. Again, this doll must be pumped with each occurrence of expansion.

Figurines have also been designed with pneumatically extendable arms or legs. U.S. Pat. No. 4,583,957 discloses a toy in the form of a robot with extendable arms. The arms extend through the introduction of pressurized air into expandable bellows which form the arms. However, as with the previously described toys here again an air pump must be actuated with each occurrence of arm expansion. As such, this reference also does not disclose a toy which may be actuated immediately or repetitively to enhance the playability of the toy.

Accordingly, it is seen that a need remains for a figurine which may physically change in appearance quickly and repetitively. It is to the provision of such therefore that the present invention is primarily directed.

SUMMARY OF THE INVENTION

In a preferred form of the invention a toy figurine comprises an air pump, a pressure tank in fluid communication with the air pump, a pneumatically actuatable appendage, and a control valve which controls the flow of pressurized air from the air tank to the pneumatically actuatable appendage. With this construction, the flow of pressurized air from the pressure tank to the appendage causes the actuation of the appendage.

BRIEF DESCRIPTION OF THE-DRAWING

DETAILED DESCRIPTION

Figure 1:
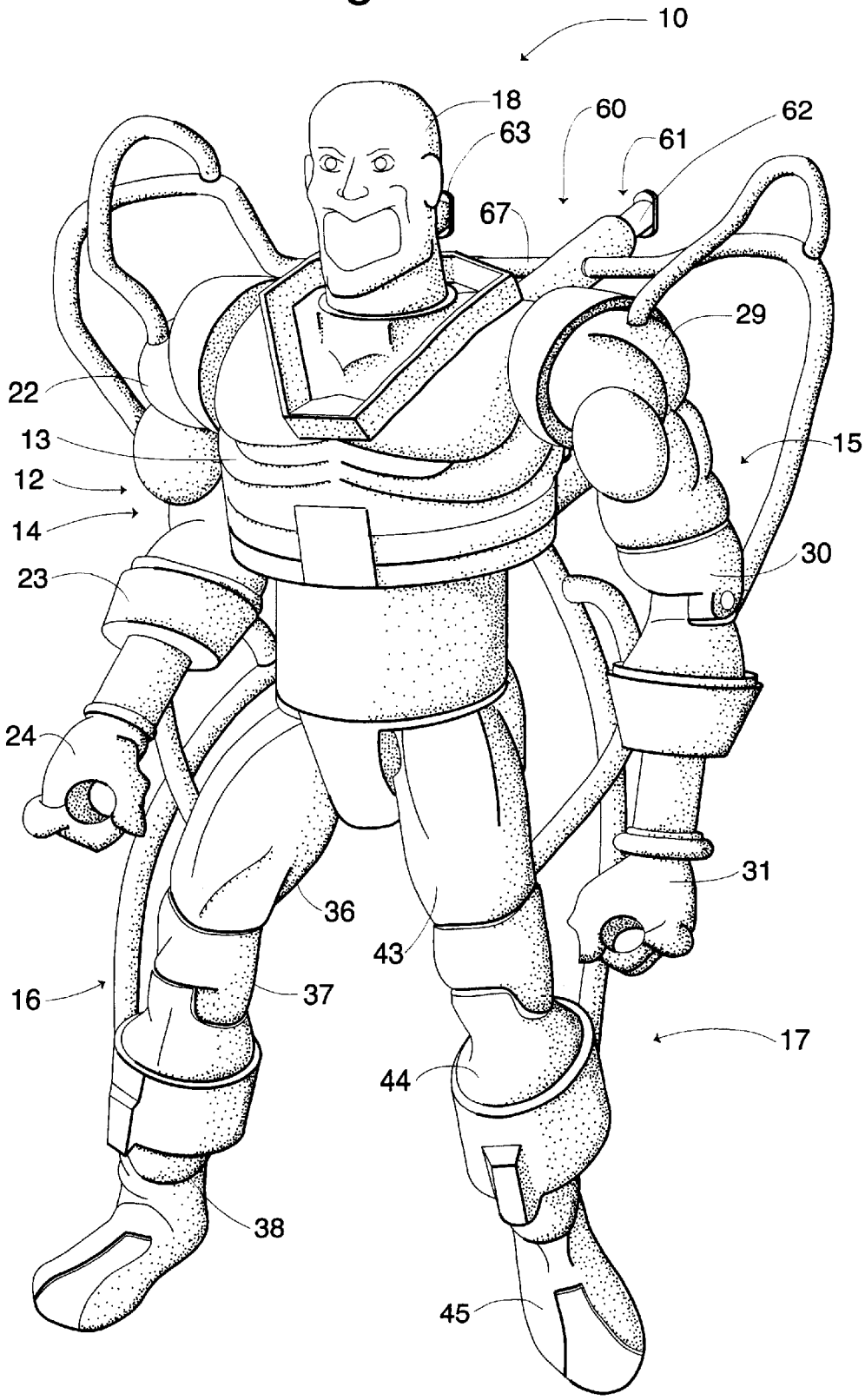
FIG. 1 is a perspective view of a toy figurine embodying principles of the invention is a preferred form, shown in a retracted configuration.

With reference next to the drawings, there is shown a toy figurine 10 in a preferred form of the invention. The toy figurine 10 has a shell body 12 having a torso 13, a right arm 14, a left arm 15, a right leg 16, a left leg 17 and a head 18. The right arm 14 has a right shoulder portion 22, a right elbow portion 23 and a right wrist portion 24. The right shoulder portion 22 is coupled to the right elbow portion 23 by an upper right arm pneumatic cylinder 25. The right elbow portion 23 is coupled to the right wrist portion 24 by a lower right arm pneumatic cylinder 26. The left arm 15 has a left shoulder portion 29, a left elbow portion 30 and a left wrist portion 31. The left shoulder portion 29 is coupled to the left elbow portion 30 by an upper left arm pneumatic cylinder 32. The left elbow portion 30 is coupled to the left wrist portion 31 by a lower left arm pneumatic cylinder 33.

The right leg 16 has a right thigh portion 36, a right knee portion 37 and a right foot portion 38. The right thigh portion 36 is coupled to the right knee portion 37 by an upper right leg pneumatic cylinder 39. The right knee portion 37 is coupled to the right foot portion 38 by a lower right leg pneumatic cylinder 40. The left leg 17 has a left thigh portion 43, a left knee portion 44 and a left foot portion 45. The left thigh portion 43 is coupled to the left knee portion 44 by an upper left leg pneumatic cylinder 46. The left knee portion 44 is coupled to the left foot portion 45 by a lower left leg pneumatic cylinder 47. The upper right leg pneumatic cylinder 39, lower right leg pneumatic cylinder 40, upper left leg pneumatic cylinder 46, lower left leg pneumatic cylinder 47, upper right arm pneumatic cylinder, lower right arm pneumatic cylinder 26, upper left arm pneumatic cylinder 32 and lower left arm pneumatic cylinder 33 may each be referred to as an appendage pneumatic cylinder.

The figurine 10 also includes an internally mounted manual air pump 50 positioned within an internal pressure tank 51. The air pump 50 includes a conventional cylinder 53, a cylinder rod 54 and a handle in the form of the figurine head 18 mounted to an end of the cylinder rod 54 extending from the torso 13. The air pump 50 is in fluid communication with the pressure tank 51 through an opening 56 in the air pump having a check valve 57 to prevent the passage of pressurized air back from the pressure tank 51 to the air pump 50. The pressure tank 51 is coupled to a conduit system 60 having a multiple control valve assembly 61. The multiple control valve assembly 61 controls the flow of pressurized air through the individual conduits of the conduit system 60, as described in more detail hereafter.

Figure 4:
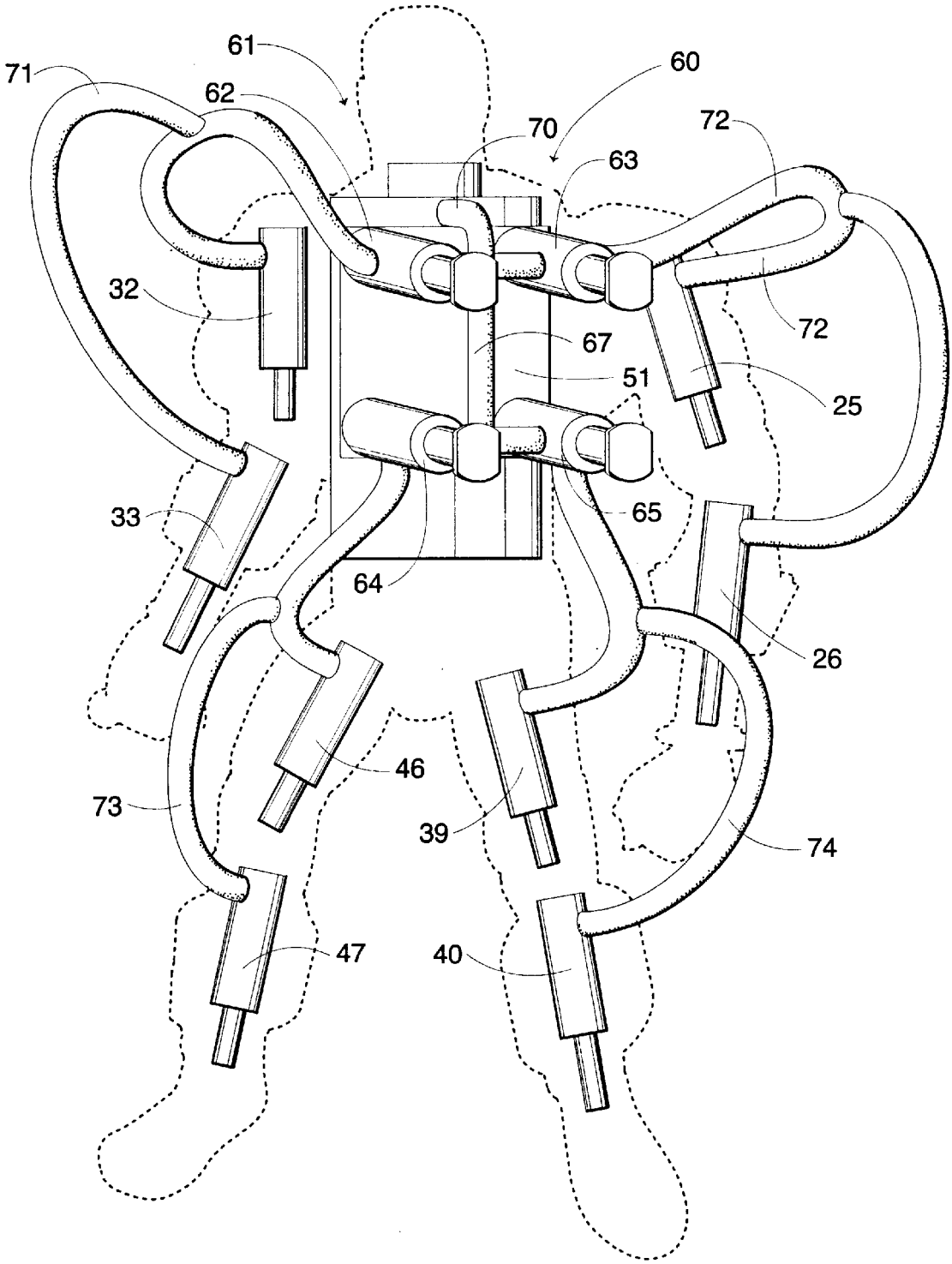
FIG. 4 is a rear view of the pneumatic components of the toy figurine of FIG. 1.

As best shown in FIG. 4, the multiple control valve assembly 61 includes a left arm control valve 62, a right arm control valve 63, a left leg control valve 64 and a right leg control valve 65, also referred to as appendage control valves. All four control valves 62, 63, 74, and 65 are coupled in fluid communication with an I-shaped central conduit 67.

The remaining portions of the conduit system 60 include a main supply tube 70 extending from the pressure tank 51 to the central conduit 67 of the multiple control valve assembly 61, a left arm conduit 71, a right arm conduit 72, a left leg conduit 73 and a right leg conduit 74. The left arm conduit 71 extends from the left arm control valve 62 to the upper left arm pneumatic cylinder 32 and the lower left arm pneumatic cylinder 33. The right arm conduit 72 extends from the right arm control valve 63 to the upper right arm pneumatic cylinder 25 and the lower right arm pneumatic cylinder 26. The left leg conduit 73 extends from the left leg control valve 64 to the upper left leg pneumatic cylinder 46 and the lower left leg pneumatic cylinder 47. The right leg conduit 74 extends from the right leg control valve 65 to the upper right leg pneumatic cylinder 39 and the lower right leg pneumatic cylinder 40. The left arm conduit 71, right arm conduit 72, left leg conduit 73 and right leg conduit 74 may each be referred to as an appendage conduit.

Figure 5:
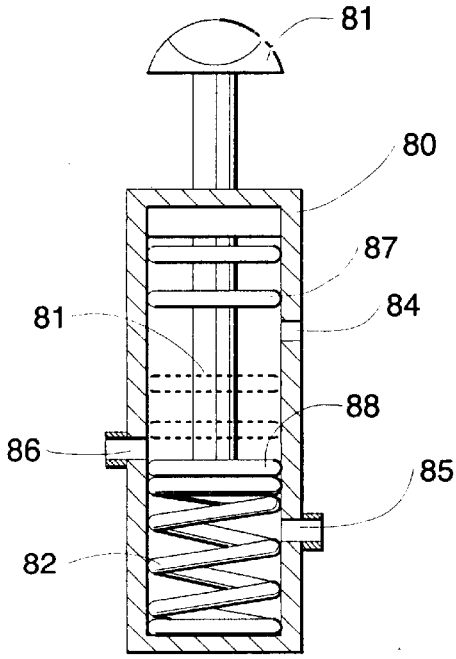
FIG. 5 is a partial cross-sectional view of the control valve of the toy figurine of FIG. 1.

With reference next to FIG. 5, there is shown one of the control valves 62, 63, 64 or 65 of toy figurine 10. Each control valve has a manifold 80, a piston 81 and a piston spring 82. The manifold 80 includes an air vent 84, an air inlet 85 coupled to the central conduit 67, and an air inlet/outlet 86 coupled to one of the corresponding appendage conduits 71, 72, 73 or 74. The piston 81 is mounted within the manifold 80 for reciprocal movement therein between an appendage pressurizing position, shown in phantom lines, and a releasing position. The piston 81 is biased by spring 82 towards its releasing position. The piston 81 includes an upper seal 87 and a lower seal 88.

Figure 6:
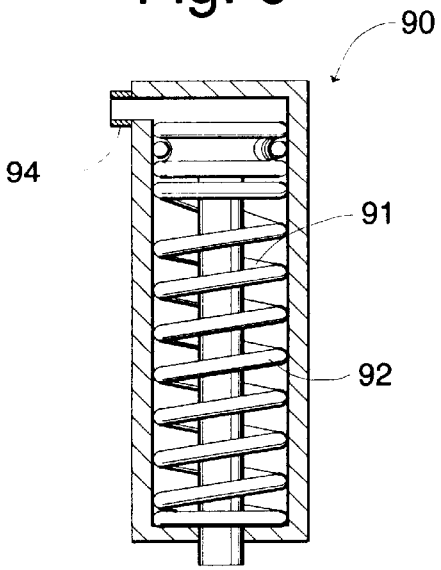
FIG. 6 is a partial cross-sectional view of the pneumatic cylinder of the toy figurine of FIG. 1, shown in a non-pressurized configuration.
Figure 7:
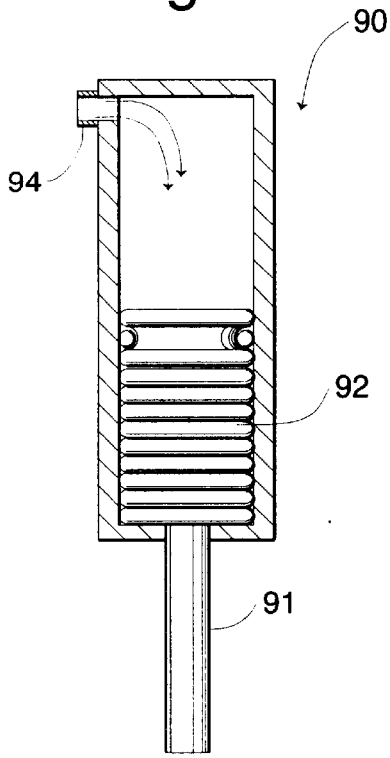
FIG. 7 is a partial cross-sectional view of the pneumatic cylinder of the toy figurine of FIG. 1, shown in a pressurized configuration.

With reference next to FIGS. 6 and 7, there is shown one of the appendage pneumatic cylinders 25, 26, 32, 33, 39, 40, 46 or 47. Each pneumatic cylinder has a manifold 90, a piston 91 and a piston spring 92. The manifold 90 has an air inlet/outlet 94 coupled to a corresponding appendage conduit 71, 72, 73 or 74. The piston 91 is mounted for reciprocal movement within the manifold 90 between an unpressurized or retracted position, shown in FIG. 6, and a pressurized or extended position, shown in FIG. 7.

Figure 2:
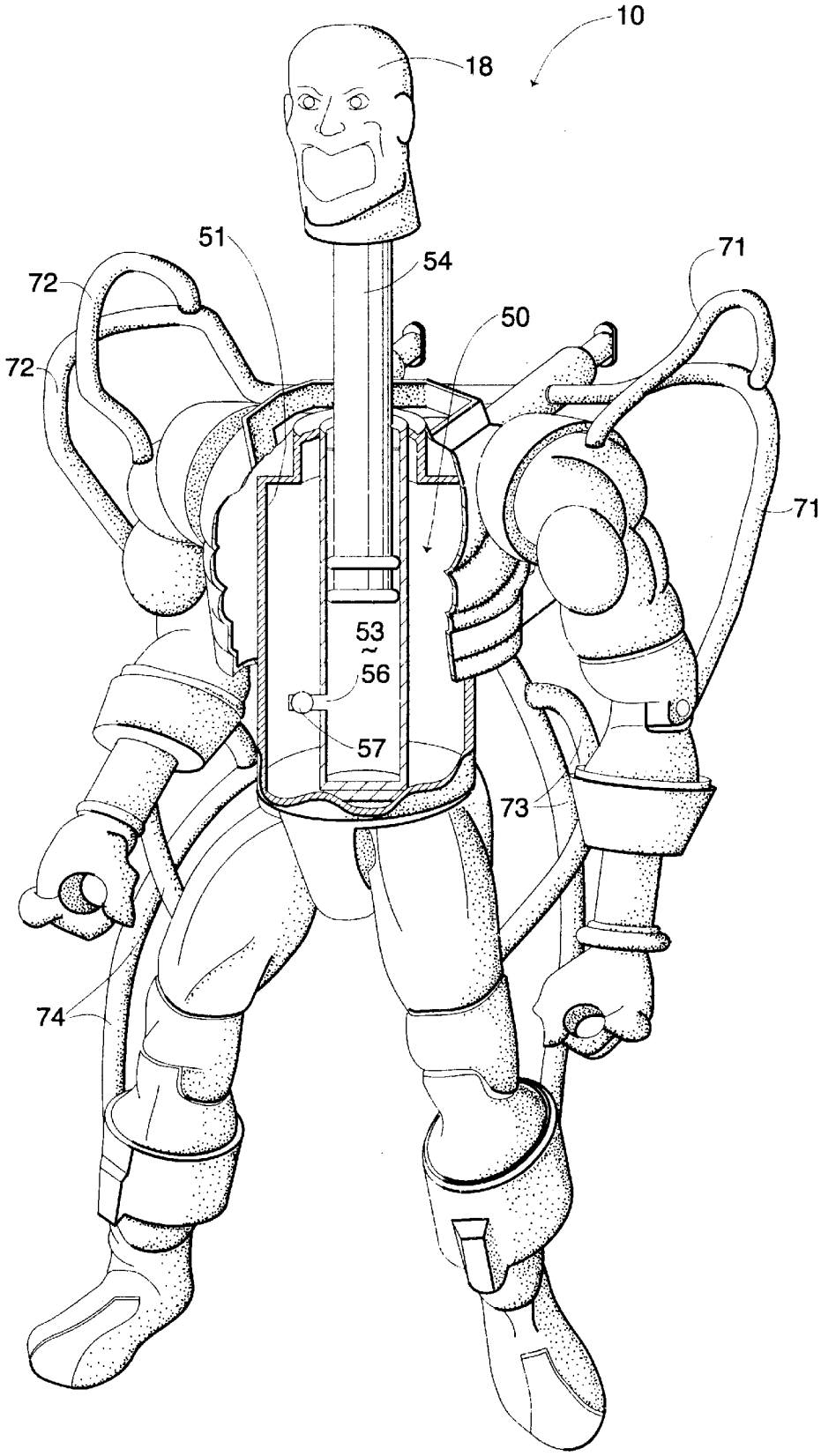
FIG. 2 is a perspective view of the toy figurine of FIG. 1 shown in partial cross-section to illustrate internal components.

In use, the air pump 50 is reciprocated, through the movement of the pump rod 54 so as to pressurize air within the cylinder 53. The pressurized air is passed through opening 56 and check valve 57 and into pressure tank 51, as shown in FIG. 2. The pressurized air within the pressure tank 51 may then be released through the manual actuation of one of the control valves 62, 63, 64 or 65 of the control valve assembly 61. The manual actuation of the control valve causes the control valve piston 81 to be moved from its releasing position to its pressurizing position, shown in phantom lines, so that the upper seal 87 and lower seal 88 straddle the air inlet 85 and air inlet/outlet 86. With the seals 87 and 88 in this position pressurized air within the pressure tank 51 flows from the pressure tank 51 through the main supply tube 70, through the central conduit 67 and into the control valve through the air inlet 85. The pressurized air then continues from the control valve through the air inlet/outlet 86, through the corresponding appendage conduit 71, 72, 73 or 74 and into a pair of the corresponding appendage pneumatic cylinders 25, 26, 32, 33, 39, 40, 46 or 47. In other words, the actuation of the control valves places the pressure tank 51 in fluid communication with the pneumatic cylinder corresponding to the actuated control valve.

Figure 3:
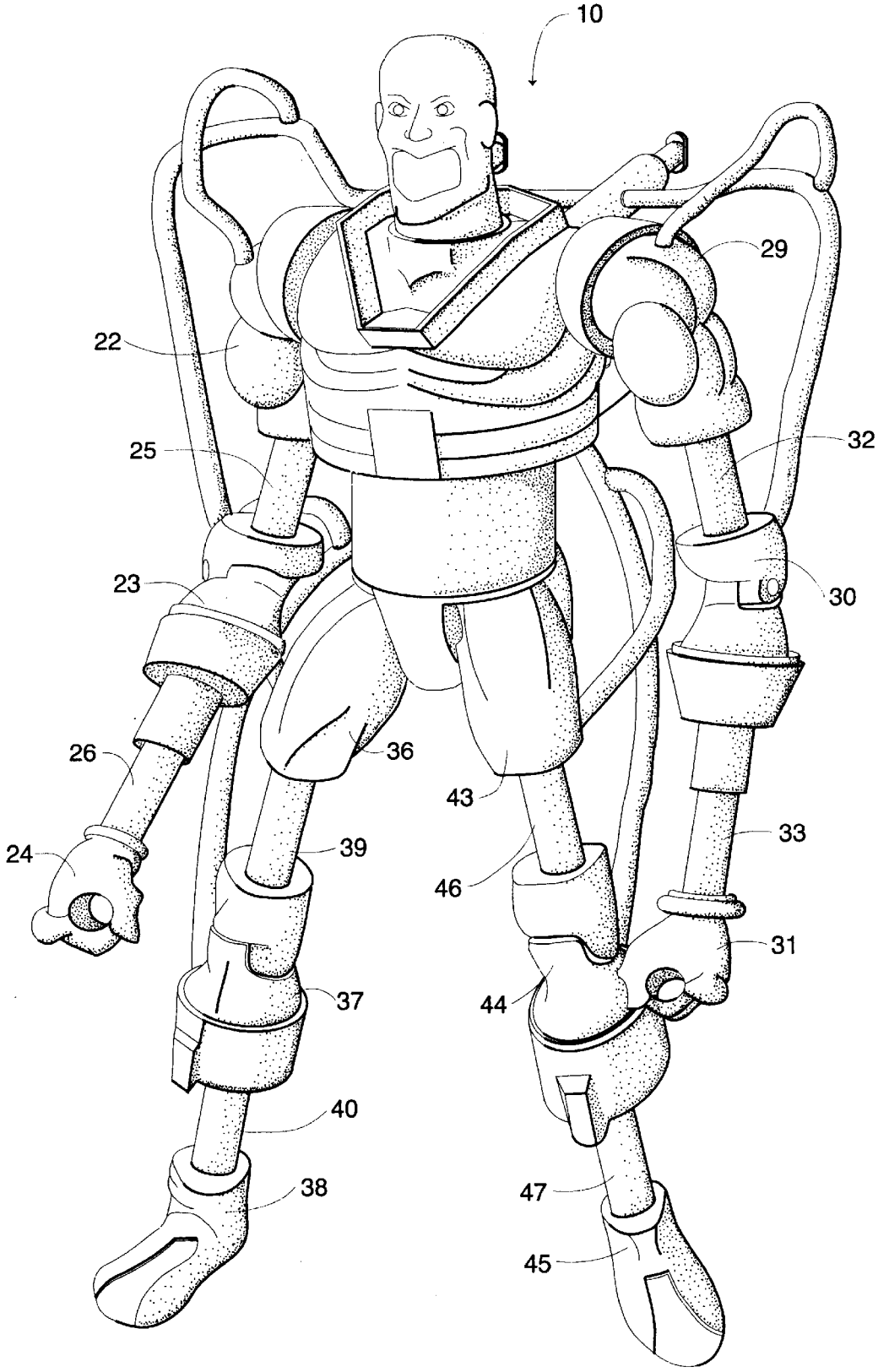
FIG. 3 is a perspective view of the toy figurine of FIG. 1, shown in an expanded configuration.

The introduction of pressurized air into an appendage pneumatic cylinders causes the pneumatic cylinder pistons 91 to be forced to their pressurized or extended position, as shown in FIG. 7. This actuation of the appendage pneumatic cylinders causes an extension of the corresponding leg or arm, as best illustrated in FIG. 3 which shows all appendages in their extended positions. With regard to the arms, the elbow portions 23, 30 move away from the shoulder portions 22, 29 through the extension of upper arm pneumatic cylinders 25, 32, and the wrist portions 24, 31 move away from the elbow portions 23, 30 through extension of the lower arm pneumatic cylinders 26, 33. With regard to the legs, the knee portions 37, 44 move away from the thigh portions 36, 43 through extension of the upper leg pneumatic cylinders 39, 46, and the foot portions 38, 45 move away from the knee portions 37, 44 through extension of the lower leg pneumatic cylinder 40, 47. As such, the figurine appears to grow or extend in length through the extensions of its appendages.

With the manual release of the control valve 62, 63, 64 or 65 the biasing force of control valve spring 82 returns the control valve piston 81 to its pressure releasing position with the upper and lower seals 87 and 88 straddling the air vent 84 and the air inlet/outlet 86. With the control valve piston 81 in its releasing position the pressurized air with the pressurized appendage pneumatic cylinder flows back through the corresponding appendage conduit 71, 72, 73 or 74 and into the corresponding appendage control valve 62, 63, 64 or 65 coupled thereto. The pressurized air within the control valve then continues, through vent 84 to ambience, i.e. the pressurized pneumatic cylinder is placed in fluid communication with ambience. With the release of the pressurized air within the appendage pneumatic cylinder the pneumatic cylinder spring 92 returns the pneumatic cylinder piston 91 to its unpressurized or retracted position, thereby returning the figurine to its normal or un-extended configuration, as shown in FIG. 1.

Figure 8:
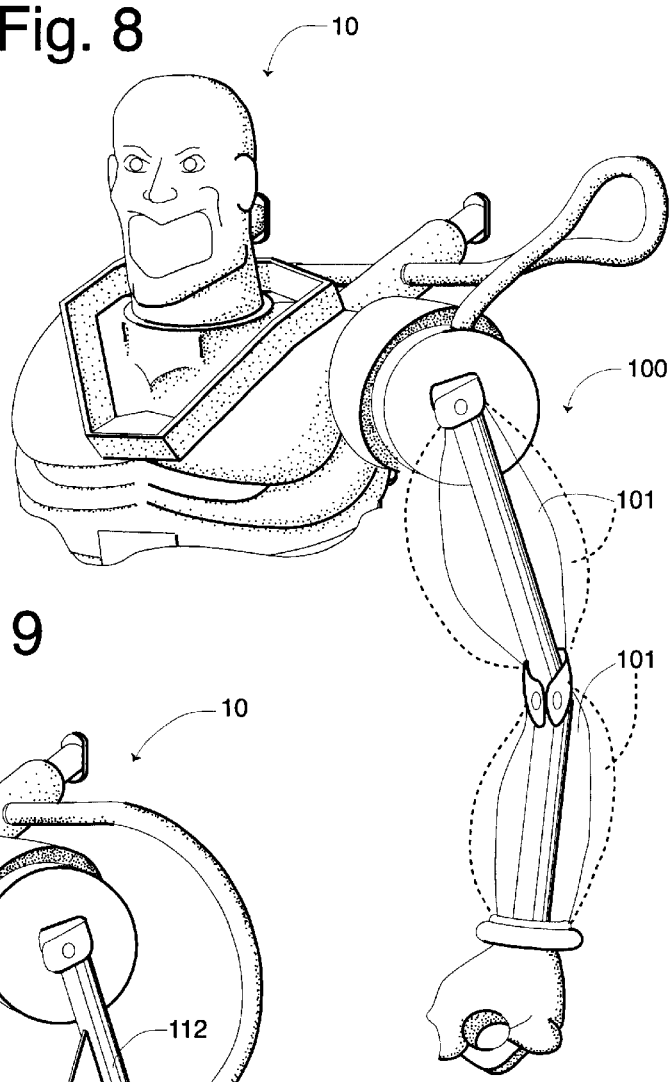
FIG. 8 is a perspective view of a portion of a toy figurine in another preferred form of the invention.

With reference next to FIG. 8, the figurine is shown in another preferred embodiment having a different type of actuatable appendage. Here, the actuatable appendage 100 is in the form of an elastic bladder 101. The pressurization of the bladder 101 through the previously described transfer of pressurized air causes the bladder 101 to expand, as shown in phantom line. The expandable bladder 101 returns to its relaxed or un-expanded configuration through the elastic nature of the bladder. This type of bladder simulates the growth of muscle mass.

Figure 9:
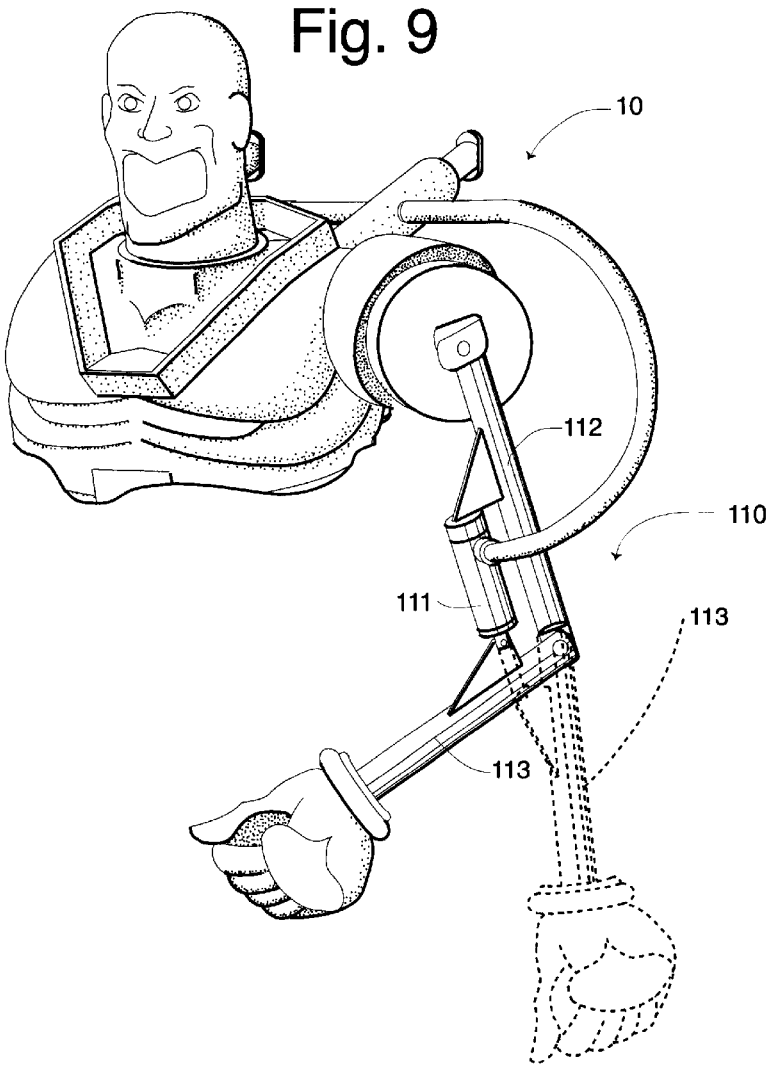
FIG. 9 is a perspective view of a portion of a toy figurine in another preferred form of the invention.

With reference next to FIG. 9, there is shown another preferred embodiment of the invention having yet another type of actuatable appendage 110. Here, the actuatable appendage 110 is in the form of a pneumatic cylinder 111 coupled between an upper arm 112 pivotally coupled to a lower arm 113. The pressurization of the pneumatic cylinder 111 causes the pneumatic cylinder to extend, as previously described, and thereby cause the pivotal motion of the lower arm 113 relative to the upper arm 112. The depressurization of the pneumatic cylinder, as previously described, returns the arm to its initial position.

It should be understood that the pressure tank enables the repetitive actuation of the pneumatic cylinders without having the manually actuate the pump each time, as with those figurines of the prior art. This repetitive actuation provides a more realistic action of the figurine, thereby increasing the toy's playability.

It thus is seen that a toy figurine is now provided which enables a child to actuate the appendages of the figurine in a repetitive manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A toy figurine comprising:

an air pump;

a pressure tank in fluid communication with said air pump;

a pneumatically actuatable appendage having a pneumatic cylinder in fluid communication with said pressure tank, said pneumatic cylinder having a piston and a manifold containing said piston, said piston being adapted for reciprocal movement between a retracted position relative to said cylinder to provide a select appendage length and an extended position relative to said cylinder to extend the length of said appendage relative to said select appendage length; and a control valve which controls the flow of pressurized air from said pressure tank to said pneumatically actuatable appendage;

whereby the flow of pressurized air from the pressure tank to the appendage causes the actuation of the appendage.

2. The toy figurine of claim 1 wherein said pneumatic cylinder further includes a spring adapted to bias said piston in an opposite direction to the biasing force of the pressurized air within said pneumatic cylinder.

3. The toy figurine of claim 1 wherein said appendage is in the form of a leg.

4. The toy figurine of claim 1 wherein said appendage is in the form of an arm.

5. A toy figurine comprising:

a pressure tank adapted to contain a supply of pressurized air;

a conduit coupled in fluid communication with said pressure tank;

a control valve coupled to said conduit which controls the flow of pressurized air through said conduit; and an actuatable appendage coupled in fluid communication with said conduit, said actuatable appendage having a pneumatic cylinder having a manifold and a piston mounted within said manifold for reciprocal movement between an extended configuration wherein said appendage has a select length and a retracted configuration wherein said appendage has a length less than said select length;

whereby the actuation of the actuatable appendage pneumatic cylinder is controlled by the flow of pressurized air from the pressure tank to the appendage.

6. The toy figurine of claim 5 further comprising an air pump in fluid communication with said pressure tank.

7. The toy figurine of claim 5 wherein said pneumatic cylinder further includes a spring adapted to bias said piston.

8. The toy figurine of claim 5 wherein said appendage is in the form of a leg.

9. The toy figurine of claim 5 wherein said appendage is in the form of an arm.

10. A toy figurine comprising:

an air pump;

a pressure tank;

a pneumatically actuatable appendage adapted for reciprocal, pneumatic movement between a retracted configuration wherein the appendage has a select length and an extended configuration wherein the appendage has a length greater than said select length, said pneumatically actuatable appendage includes a pneumatic cylinder having a manifold and a piston mounted within said manifold for reciprocal movement between an extended position corresponding to said extended configuration of said appendage and a retracted position corresponding to said retracted configuration of said appendage;

a conduit extending between said pressure tank and said pneumatically actuatable appendage; and a control valve which controls a flow of pressurized air through said conduit;

whereby the flow of pressurized air from the pressure tank to the appendage causes the actuation of the appendage.

11. The toy figurine of claim 10 wherein said pneumatic cylinder further includes a spring adapted to bias said piston in an opposite direction to the biasing force of the pressurized air within said pneumatic cylinder.

* * * * *